United States Patent [19]

Oya

[11] Patent Number: 4,570,367

[45] Date of Patent: Feb. 18, 1986

[54] FRONT-MOUNTED, SHOCK-ABSORBING ATTACHMENT MEANS FOR A SNOWPLOW ON A VEHICLE

[75] Inventor: Anders Oya, Fiane, Norway

[73] Assignee: Stiansen & Oya A/S, Fiane, Norway

[21] Appl. No.: 694,158

[22] Filed: Jan. 23, 1985

[30] Foreign Application Priority Data

Jan. 23, 1984 [NO] Norway ..... 840237

[51] Int. Cl.[4] ..... E01H 5/04

[52] U.S. Cl. ..... 37/232; 172/816; 293/138

[58] Field of Search ..... 37/232, 233; 293/102, 293/112, 138–139; 172/816

[56] References Cited

U.S. PATENT DOCUMENTS

| | | | |
|---|---|---|---|
| 2,614,344 | 10/1952 | Rust | 37/232 |
| 3,158,944 | 12/1964 | Rehberg et al. | 172/816 |
| 3,238,647 | 3/1966 | Hall et al. | 172/816 |
| 3,400,475 | 9/1968 | Peitl | 37/233 |
| 3,883,965 | 5/1975 | Poirier et al. | 172/816 |
| 4,029,157 | 6/1977 | Freese | 172/816 |
| 4,031,968 | 6/1977 | Krolak et al. | 172/816 |
| 4,074,896 | 2/1978 | Eftefield | 172/816 |

FOREIGN PATENT DOCUMENTS

| | | | |
|---|---|---|---|
| 385264 | 3/1965 | Switzerland | 37/232 |
| 735703 | 5/1980 | U.S.S.R. | 37/232 |

*Primary Examiner*—E. H. Eickholt

*Attorney, Agent, or Firm*—Cushman, Darby & Cushman

[57] ABSTRACT

A front-mounted, shock-absorbing attachment means for a snowplow on a vehicle, comprising a substantially vertical front plate with fastening means for detachable mounting of the snowplow. The upper section of the front plate is pivotally secured to the frame of the vehicle, and its lower section, via buffer cylinders adjustable in length and pivotally fastened at one end thereof to the front plate, is supported against the front wheel axle of the vehicle by means of respective brackets which are rigidly clamped to respective brackets which are rigidly clamped to respective leaf spring assemblies in front of the front wheel axle and which rest directly or indirectly against the leaf spring assembly. The point of attachment of the buffer cylinder on the bracket thus is located forward of the front wheel axle and lower than the leaf spring assembly, and when the buffer cylinders are subjected to loading from the front plate, said point will be caused to pivot backwardly about a point of contact on the front wheel axle and thereby bend the spring assembly downwardly in front of the front wheel axle. This will cause the front plate to pivot backwardly somewhat about its pivotal supports on the vehicle frame. This relieves shocks on the vehicle frame caused by the possible impact of the snowplow against obstructions in the road, in addition to the shock absorption that occurs upon compression of the buffer cylinder. The front plate can be adjusted to the desired position by means of the adjustable-length buffer cylinders, such that when the front plate has been pivoted backwardly as far as possible, it will assume an approximately vertical position.

5 Claims, 1 Drawing Figure

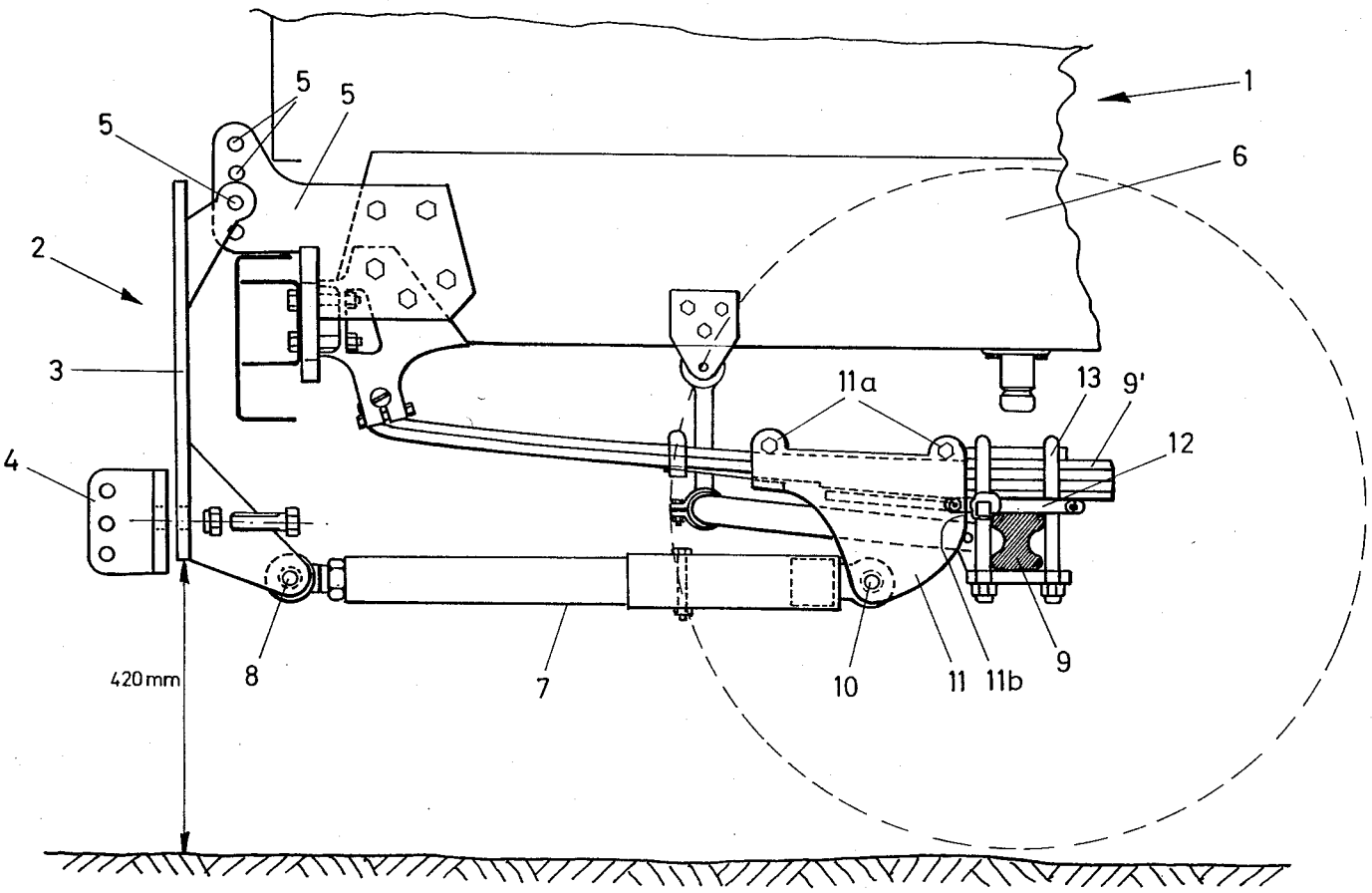
1
6
12
9'
13
9
11b
11
11a
10
7
5
5
5
8
420mm
2
3
4

FRONT-MOUNTED, SHOCK-ABSORBING ATTACHMENT MEANS FOR A SNOWPLOW ON A VEHICLE

The present invention relates to a front-mounted, shock-absorbing attachment means for a snowplow on a vehicle, of the type recited in the preamble of the appurtenant independent claim 1.

A very important consideration with snowplow attachment means of this type is that the front plate of the attachment means, under maximum loading from the snowplow which will occur particularly when there is a great amount of snow being removed or when the snowplow encounters hindrances in the road, should not pivot back too far around its upper point of support on the frame of the vehicle. This is particularly important when a V-shaped snowplow is mounted on the attachment means by means of a parallelogram linkage. If the front plate pivots too much, this will cause the tip of the V-shaped snowplow to point downwards and dig into the ground, and the vehicle may then "run over the snowplow".

To prevent this from happening, regulations exist which specify the distance of the attachment means from the ground when the vehicle is in an unloaded state, the distance between the upper and lower coupling means on the attachment member, and which state that the front plate shall not exhibit any appreciable amount of pivot under loading which would cause the tip of the plow to dig into the ground. The latter regulation is particularly applicable when the lower support for the front plate consists of shock absorber or buffer cylinders which become somewhat compressed when subjected to high loading, especially shock loads. When rubber members are used as the shock-absorber in such cylinders, these must be made of very hard rubber, e.g. 90 shore. With shock absorbers of this type, the maximum compression will be 5–6 mm, which corresponds to the amount of pivot of the front plate, at the lower edge thereof.

Increased resilience or shock-absorbing capacity for the front plate would be desirable, but only if this could be achieved without substantially increasing its degree of pivot.

The object of the present invention is to provide a shock-absorbing snowplow attachment means of the above type which provides increased shock absorption/damping compared to a prior art construction without substantially increasing the amount of pivoting of the front plate.

This is obtained according to the invention by means of the characteristic features recited in the characterizing clause of the appurtenant independent claim 1 and in the succeeding dependent claims.

By means of the attachment means disclosed in the claims, the total loading transmitted between the snowplow and the vehicle in the event of a collision or on impact with an obstruction can be reduced by about two-thirds.

The invention will be described in greater detail in the following with reference to the accompanying drawing, which shows the front part of the vehicle frame and front-wheel suspension with the snowplow attachment means mounted thereon.

Mounted on the front of a vehicle 1 is an attachment means 2 for a snowplow, comprising a substantially vertical front plate 3 with coupling means 4 for detachable mounting of a snowplow. The upper section of the front plate 3 is pivotally attached at 5 to a bracket 5' that is secured to the vehicle frame 6, and the bracket comprises a plurality of fastener holes 5'' disposed vertically for regulating the height of the front plate 3. The lower section of the front plate 3, via adjustable shock absorbers or buffer cylinders 7, is supported against the front wheel axle 9 of the vehicle 1 which is fastened to longitudinal leaf spring assemblies 9', which are suspended from the frame 6. Thus, one end of the cylinders 7 is pivotally fastened to the front plate 3 and the other end is pivotally fastened to a pivot point formed by a spherical, self-aligning bearing 10 on the lower part of respective brackets 11, which are rigidly clamped to respective leaf spring assemblies 9' in front of the front wheel axle 9. The brackets 11 rest directly or indirectly against the front wheel axle 9. Because the pivot point 10 is situated lower than the leaf spring assembly 9' and in front of the front wheel axle 9, a load exerted on the front plate 3, via the buffer cylinders 7, will cause the bracket 11 to pivot about its point of contact with the front wheel axle 9, which in turn will cause the leaf spring assembly 9' to bend downwardly. Thus, by selecting a suitable distance between the point 10 on the bracket 11 and its point of contact with the front wheel axle 9, one obtains a desired moment of rotation on the bracket and thus a corresponding downward force on the front part of the leaf spring assembly 9'. For example, if the spring assembly is bent downwardly maximum 10 mm, the buffer cylinder 7 and thus the front plate 3 will pivot back about 3 mm. If at the same time the buffer cylinder 7 at maximum loading is compressed maximum 5–6 mm, the maximum length of the amount of pivot at the lower edge of the front plate 3 will be 8–9 mm. To prevent the tip of the snowplow from digging into the ground if a collision occurs or under heavy loading, as discussed above, it is desirable that the front plate 3 under maximum loading should not pivot from its vertical position. Therefore, to ensure that the front plate under maximum pressure or shock will stop in the correct position, about 90° relative to the ground plane, the front plate can be pivoted forwardly 7–9 mm by means of the adjustable-length buffer cylinders.

The bracket 11 has an elongated fastening means to the leaf spring assembly 9' with fastening means **11*a* spaced apart for ensuring good transfer of the moment of rotation of the bracket 11 to the leaf spring assembly 9'**.

At the rear edge **11*b* of the bracket 11, a U-shaped retainer bar 12 is pivotally fastened, and the U-bar surrounds a known per se clamp 13 which secures the front wheel axle 9 to the leaf spring assembly 9'. The U-bar 12 secures and retains the bracket 11** in place when the vehicle is being driven in reverse with the snowplow blade resting on the ground.

According to the regulations currently in force for mounting an attachment means for a V-configuration snowplow having a parallelogram linkage, it is recommended that the distance between ground level and the lower edge of the front plate 3 be at least 420 mm. It is also recommended that the vertical distance between the upper and lower fasteners 5, 8 on the front plate 3 be at least 400 mm. These regulations have been taken into account in the above-defined limits for the compression of the buffer cylinders 7 and the downward deflection of the leaf spring assembly 9'.

Having described my invention, I claim:

1. A front-mounted, shock-absorbing attachment means (2) for a snowplow on a vehicle (1), comprising a substantially vertical front plate (3) with fastening means (4) for detachable mounting of the snowplow, wherein the upper section of the front plate (3) is pivotally fastened (5) to the frame (6) of the vehicle, and the lower section of the front plate (3), via buffer cylinders (7) whose length is adjustable and one end of which is pivotally attached (8) to the front plate (3), is supported against the front wheel axle (9) of the vehicle, said axle being attached to longitudinal leaf spring assemblies (9') connected to the frame (6) of the vehicle (1), characterized in that the other ends of the buffer cylinders (7) are pivotally fastened to a point (10) situated lower than the leaf spring assembly (9') and in front of the front wheel axle (9) by means of respective brackets (11) which are rigidly clamped to respective leaf spring assemblies (9') in front of the front wheel axle (9) and which rest directly or indirectly against the spring assembly (9'), whereby when the buffer cylinders (7) are subjected to loading from the front plate (3), the cylinders (7) will become somewhat compressed and this will cause the bracket (11) to pivot backwardly about its point of contact on the front wheel axle (9), thereby bending the leaf spring assembly (9') downwardly in front of the front wheel axle (9), which causes the front plate (3) to pivot backwardly somewhat about its pivotal supports (5) on the vehicle frame (1).

2. A snowplow attachment means according to claim 1, characterized in that the upper section of the bracket (11) with clamping means (11*a*) extends across a portion of the length of the leaf spring assembly (9') and the rear edge (11*b*) of the upper section of the bracket (11) rests directly or indirectly against the front wheel axle (9), and that the lower section of the bracket (11) extends beneath the leaf spring assembly (9') and comprises the fastening point (10) of the buffer cylinder (7).

3. A snowplow attachment means according to claim 2, characterized by a U-shaped retainer bar (12) pivotally fastened at the rear edge (11*b*) of the bracket (11) which surrounds a known per se clamp (13) for securing the front wheel axle (9) to the leaf spring assembly (9'), said bar holding the bracket (11) in place when the vehicle is being driven in reverse with the snowplow blade resting on the ground.

4. A snowplow attachment means according to claim 1, characterized in that the maximum compression of the buffer cylinders (7) is in the range of 5–6 mm, and that the maximum downward deflection of the leaf spring assembly (9') is about 10 mm, which in the event of a collision or heavy loading causes a shock-absorbing backward pivoting of the front plate (3).

5. A snowplow attachment means according to claim 4, characterized in that the front plate (3) in an unloaded state, by means of the adjustable-length buffer cylinders (7), is somewhat forwardly pivoted, such that when the front plate (3) is subjected to approximately maximum loading, it will be pivoted backwardly to assume a substantially vertical position.

* * * * *